United States Patent [19]

Matsumoto

[11] 4,142,715

[45] Mar. 6, 1979

[54] FLUID FILLED AMUSEMENT DEVICES UTILIZING FLUID MOTION

[75] Inventor: Takao Matsumoto, Tokyo, Japan

[73] Assignee: Tomy Kogyo Co., Inc., Tokyo, Japan

[21] Appl. No.: 846,552

[22] Filed: Oct. 28, 1977

[30] Foreign Application Priority Data

Nov. 4, 1976 [JP] Japan ..... 51-148206[U]

[51] Int. Cl.[2] ..... A63F 9/00

[52] U.S. Cl. ..... 273/1 L; 273/100

[58] Field of Search ..... 273/1 L, 1 R, 95 C, 273/85 H, 111, 100

[56] References Cited

U.S. PATENT DOCUMENTS 4,032,141 6/1977 Tanimura ..... 273/1 L

*Primary Examiner*—Paul E. Shapiro

*Attorney, Agent, or Firm*—Edward D. O'Brian

[57] ABSTRACT

It is known to construct amusement devices which include a transparent container filled with a body of transparent fluid, at least one object located within the body of the fluid and a pump or pump type structure for circulating the object within the fluid so as to move the object relative to a structure such as a holder or a simulated basket within the container. Such amusement devices can be improved by utilizing a target type holder at least part of which is movably mounted within the interior of the container. The pump employed includes a port located so as to be capable of directing a current of the fluid generally toward the movable part of the target so that the pressure of the current against this part of the target will cause it to move as the pump is operated to eject fluid through the port. The movable part of the target is located within the container so that its position as determined by the operation of the pump affects the relative difficulty of moving an object so that it is retained by the target.

8 Claims, 8 Drawing Figures

FLUID FILLED AMUSEMENT DEVICES UTILIZING FLUID MOTION

REFERENCE TO RELATED PATENTS

The subject of this patent application is related to the subject matter set forth in U.S. Pat. No. 4,032,141 issued June 28, 1977 entitled "AMUSEMENT DEVICE". The entire disclosure of the noted U.S. patent is incorporated herein by reference.

BACKGROUND OF THE INVENTION

The invention set forth in this specification pertains to new and improved fluid filled amusement devices utilizing fluid motion.

It is known to construct amusement devices which include a transparent container filled with a body of transparent fluid, at least one object located within the body of the fluid and pump or pump-type structure for circulating the object within the fluid so as to move the object relative to a target structure such as a holder or simulated basket within the container. Such amusement devices commonly are utilized with a variety of ball or ring-like objects located within the body of the transparent fluid employed. It is believed that all prior objects located within such a body of fluid in an amusement device of the type indicated have posessed a specific gravity greater than the specific gravity of the fluid employed so that such objects would tend to sink toward the bottom of the container as such a device is operated.

Normally such devices have been constructed so that the container used is mounted upon an opaque base containing the pump or pump-like structure employed. Such a pump or pump type structure normally has been constructed as a bellows connected to the interior of the bottom of the container by a port leading into the bottom of the container. Such a port serves as both a discharge outlet and an inlet to the bellows depending upon whether or not the bellows is being compressed or is being enlarged or allowed to expand.

In the event a container employed as indicated does not have a sloping bottom leading generally to such a port various baffels have been provided within the container so as to tend to create flow patterns for the fluid used such that any object or objects within a device of the type described will more or less automatically tend to settle toward the bottom of the container adjacent to the port where such objects can be entrained with a stream or current of fluid ejected through the port. Occasionally so-called "traps" have been located in the container adjacent to such a sloping bottom so as to restrain objects within a body of fluid from moving within such a fluid.

Amusement devices as are indicated in the preceding are considered to be quite desirable as amusement devices inasmuch as individuals tend to like to manipulate such devices while watching one or more objects circulating within them. They are also capable of being utilized as effective games such as solitaire type games in which objects are rings adapted to be captured or caught by target type projections located within the containers employed. By utilizing more than one pump or pump like structure in such an amusement device it is possible to construct such a device so as to effectively simulate common games such as basketball.

In spite of the effectiveness of amusement devices as indicated in the preceding for amusement and play type purposes it is considered that the effectiveness of such devices for amusement and play purposes can be significantly increased. There is a need for such increased effectiveness of amusement type devices as described which apparently grows out of the fact that the purchasing public continuously desires new and different toys and amusement devices having a somewhat different mode of operation than prior structures.

SUMMARY OF THE INVENTION

A broad objective of the present invention is to fulfill the need indicated in the preceding discussion. A related objective of the invention is to provide new and improved fluid filled amusement devices utilizing fluid motion of the type indicated in the preceding discussion. Further objectives of the present invention are to provide new and improved amusement devices of the type indicated which can be constructed at a comparatively nominal cost, which are of such a character as to utilize the principal or operative parts of prior amusement devices as indicated in the preceding discussion, and which are quite effective for amusement and play type purposes.

In accordance with this invention these objectives are achieved by providing an amusement device including a container at least part of which is transparent, a body of transparent fluid located within the container, at least one object located within the body of fluid, the object being visible from the exterior of the container and pump means for circulating the fluid within the container so that movement of the fluid within the container will cause movement of the object within the body of the fluid in which the improvement comprises: a target means for retaining the object as the device is used, the target means being located within the interior of the container so as to be visible from the exterior thereof, said target means being movably mounted within the container so as to be capable of moving with respect to the interior of the container during the operation of the device, the pump means having a port located so as to be capable of directing a current of fluid generally toward the part of the target means so that the pressure of the current against the part will cause movement of the part as the pump means is operated so as to eject fluid through the port, the part being located so that the position of the part resulting from the operation of the pump means affects the relative difficulty of moving the object so that it is retained by the target means.

BRIEF DESCRIPTION OF THE DRAWINGS

Because of the nature of this invention it is considered that it is best more fully described with reference to the accompanying drawings in which.

Figure 1:
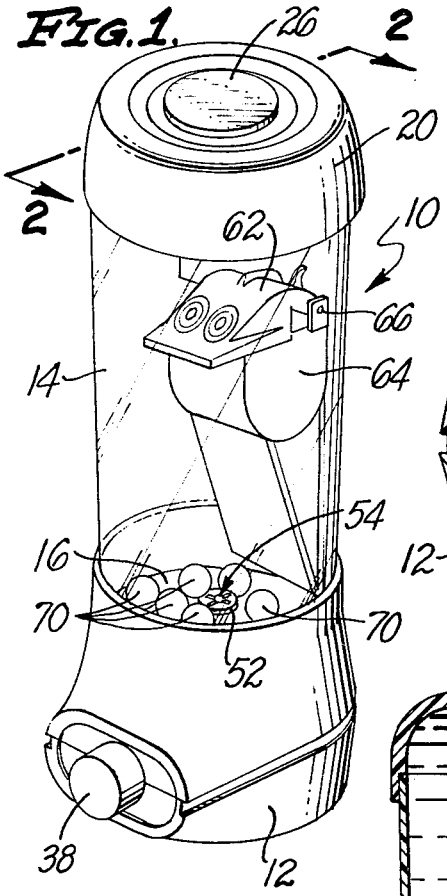
FIG. 1 is an isometric view of a presently preferred embodiment of an amusement device in accordance with this invention.
Figure 3:
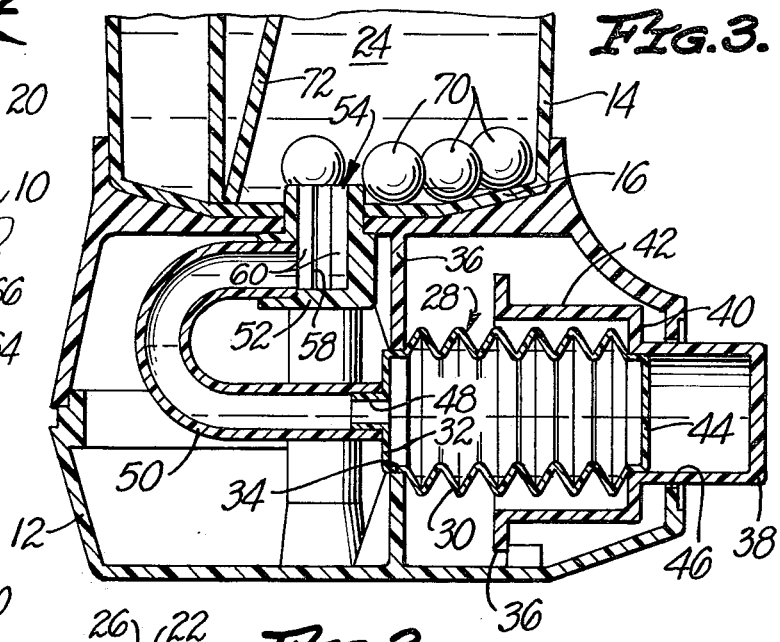
FIG. 3 is a cross-sectional view corresponding to part of FIG. 2 at an enlarged scale in which parts shown in elevation in FIG. 2 are shown in section.
Figure 2:
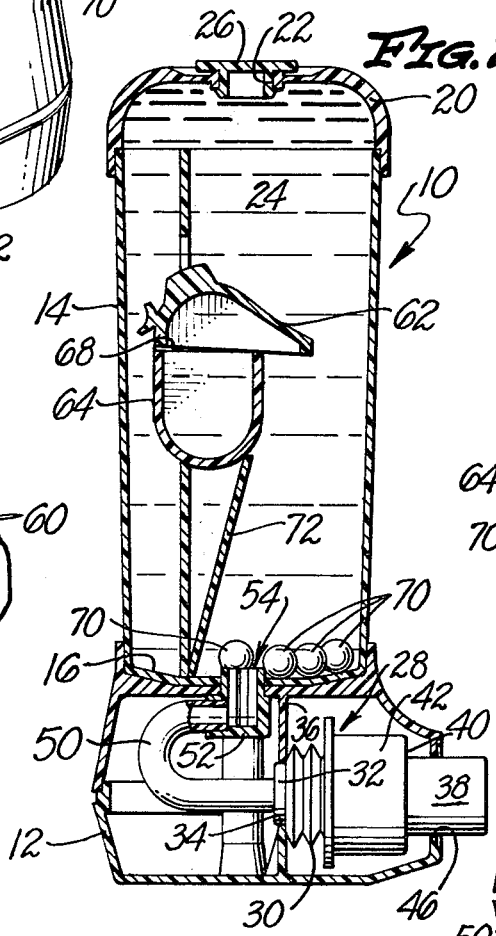
FIG. 2 is a cross-sectional view taken at line 2—2 of FIG. 1 of the device shown in FIG. 1 in which certain parts are shown in elevation.
Figure 5:
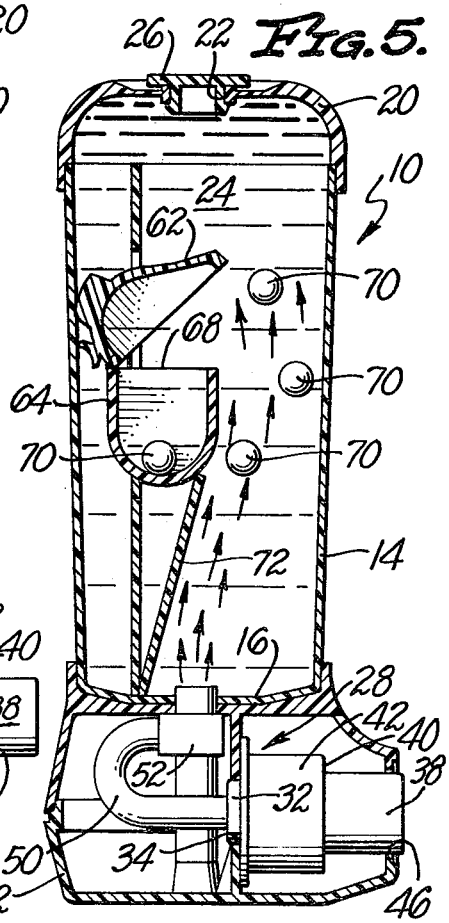
FIG. 5 is a cross-sectional view corresponding to FIG. 2 in which certain parts are illustrated as they may appear during the use of the amusement device.

The various different amusement devices illustrated in the drawing are constructed so as to utilize the essentially intangible concepts of and/or principles of the invention set forth and defined in the appended claims. It is considered that it will be obvious to anyone reasonably skilled in the field of the design and construction of toys that these concepts or principles can be embodied within a wide vareity of somewhat differently appearing and differently constructed toys.

DETAILED DESCRIPTION

In FIGS. 1 to 5 of the drawings there is shown an amusement device 10 of the present invention which is constructed so as to include a multipart base 12 serving to support a transparent, generally cylindrical container 14 having a sloping bottom 16. The top 18 of this container 14 is normally enclosed by means of a lid or cover 20. This lid or cover 20 is provided with a centrally located opening 22 for the purpose of filling nearly all of the interior of the container 14 with a body (not separately numbered) of a transparent fluid 24 such as water. A conventional closure 26 is provided for the purpose of closing off the opening 22.

The fluid 24 is adapted to be circulated within the container 14 through the use of a pump type structure 28 mounted generally within the base 12. This pump-like structure 28 includes an elongated bellows 30 formed of an appropriate flexible material such as a known polyolefin or vinyl polymer so as to include a shoulder 32. This shoulder 32 fits tightly within an opening 34 in a support wall 36 within the base 12 for the purpose of mounting the bellows 30 so that it can expand and contract.

This bellows 30 is adapted to be compressed by an individual pushing a generally cylindrical button 38 inwardly toward the base 12. This button 38 is formed in the bottom 40 of a generally cup shaped housing 42. The bellows 30 includes an end section 44 which fits tightly within the button 38 against the bottom 40 in such a manner as to effectively mount the housing 42 on the bellows 30. The button 38 extends outwardly from the base 12 through a hole 46 in this base 12 and can only be pushed inwardly a limited distance. The housing 42 is adapted to abut up against the wall 36 so as to limit the amount that the bellows 30 can be compressed.

A hollow boss 48 on the bellows 30 generally within the shoulder 32 is connected by a small tube 50 to a fitting 52 terminating in an upwardly directed port or opening 54. This tube 50 may be of a non-elastic character. It also may be formed of a somewhat elastomeric material so that it will tend to expand as the bellows 30 is compressed. When the tube 50 is formed of such an elastomeric material it will tend to act more or less in the manner of an accumulator as the bellows 30 is compressed and shortly thereafter so as to tend to sustain the flow from the bellows 30 to a minor extent after the bellows 30 has been compressed to the maximum extent possible. This fitting 52 extends through an opening 56 generally at the lowest point or center of the bottom 16 of the container 14.

Figure 4:
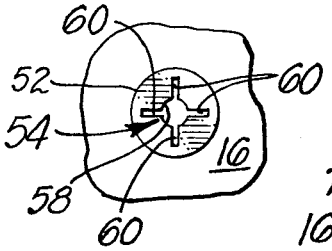
FIG. 4 is a partial cross-sectional view taken at line 4—4 of FIG. 3.

This port 54 is preferably of a cruciform type shape as indicated in FIG. 4 of the drawings so as to include a central discharge opening 58 and radially extending discharge slots 60 which extend outwardly from the opening 58. This particular shape is considered to be desirable for several reasons. There is little chance of the port 54 being blocked off when it is constructed in the manner noted. Further, when the port 54 is constructed as shown the shape of this port makes it possible to obtain flow effects which are dependent upon the manner of compression of the bellows 30. Such flow effects are considered to enhance the amusement values of the device 10.

During the operation of the device 10 the button 38 is pushed so as to compress the bellows 30. This will cause a stream or current of fluid 24 to be ejected from the port 54 generally upwardly toward a lid 62 for a receptacle 64 located within the container 14 above the bottom 16. This lid 62 is pivotally mounted by means of conventional pivots 66 on the receptacle 64 so as to extend beyond the confines of the top 68 of the receptacle 64. Thus, this lid 62 is located where it can be engaged by a current as noted by arrows in FIG. 5 so that the force exerted by the current will pivot the lid 62 to expose the interior of the receptacle 64.

In the device 10 various small balls 70 will be picked up by any such current so as to be circulated within the interior of the container 14. When the device 10 is used the user can manipulate the pump type structure 28 so as to circulate the balls 70 lift lit the lid 62 in such a manner that the balls 70 accumulate within the receptacle 64. In order to facilitate this action it is considered preferable to locate within the container 14 a baffle 72 which will tend to direct a stream of fluid ejected from the port 54 so that such stream will be comparatively effective in lifting the lid 62. Without such a baffle 72 it is considered that the device 10 would be undesirably difficult to operate in its intended manner.

The operation of the device 10 includes several features which are not readily apparent. With the structure shown the bellows 30 can only be compressed to a limited extent. As a result of this an upwardly directed stream can only be issued from the port 54 for a comparatively brief period. As a consequence of this the time when the lid 62 can be pivoted so as to expose the top 68 of the receptacle 64 is limited. Further, an individual can regulate the velocity of such a stream so as to tend to control the lifting of this lid 62. Because of the fact that the bellows 30 is operated periodically as the device 10 is used the button 38 must be released during the operation of the device 10.

Normally the inherent resiliency of the bellows 30 and the weight of the fluid within the container 14 will be adequate to automatically expand the bellows 30 upon such release to the maximum extent permitted by the geometry of the device 10. Such expansion of the bellows 30 may be assisted through the use of a spring (not shown) in a conventional manner. During any such expansion of the bellows 30 there will be a flow back into the bellows 30 through the port 54. The velocity of the flow through this port 54 will, of course, cause a variation in the flow pattern adjacent to the port 54. Any flow through the port 54 away from the interior of the container 14 will create a current within this container 14 which tends to close the lid 62 as the device 10 is operated.

Figure 6:
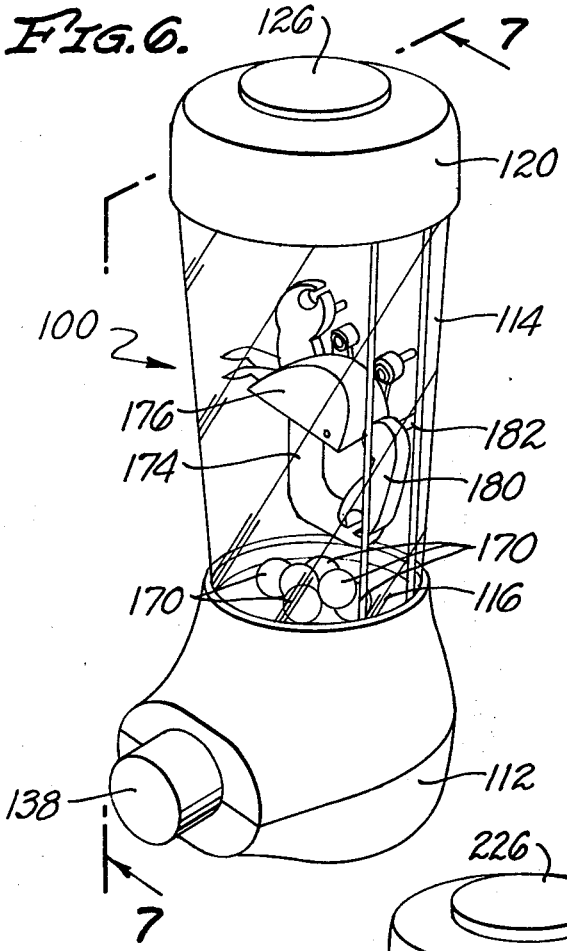
FIG. 6 is an isometric view of a modified amusement device in accordance with this invention.
Figure 7:
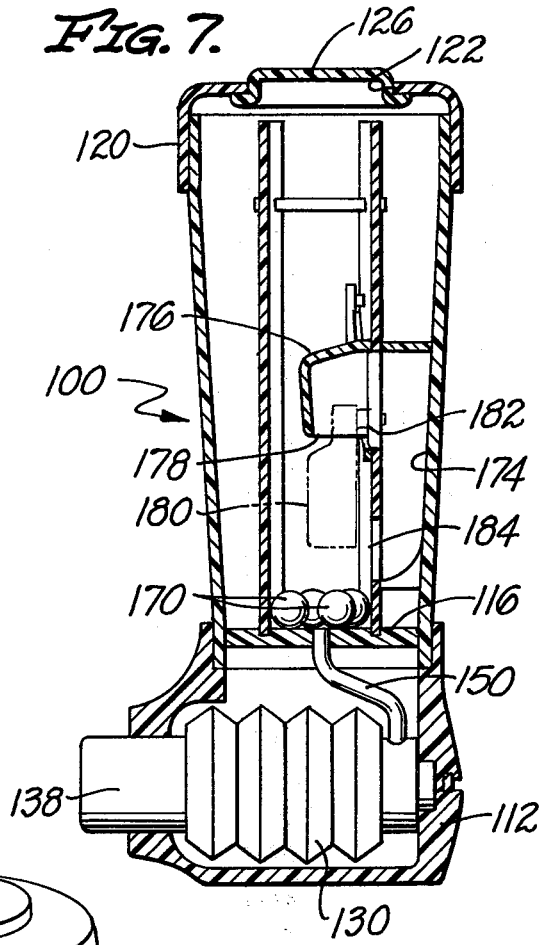
FIG. 7 is a cross-sectional view taken at line 7—7 of FIG. 6 in which certain parts are shown in elevation.

In FIGS. 6 and 7 of the drawing there is shown a modified amusement device 100 in accordance with the present invention which is essentially very similar to the device 10. Because of the relationship between the devices 10 and 100 various parts of the device 100 which are the same or substantially the same as corresponding portions of the device 10 are not separately described and are indicated in the remainder of this specification and in the drawings by the numerals used to identify such parts preceded by the numeral "1".

The essential difference between the devices 10 and 100 relates to the receptacles employed in these two devices. In the device 10 the receptacle 64 is normally closed by means of a lid 62. After all of the ballls 70 have been located in this receptacle 64 the device 10 may be turned upside down so as to open the lid 64 and remove objects 70 from the receptacle 64. As opposed to this in the device 100 a receptacle 174 is utilized which includes an immobile extending baffle-like lid 176 having a downwardly directed opening 178. This opening 178 is positioned so that balls 70 may be circulated upwardly through the opening 178 into the receptacle 174.

With the device 100 a paddle-like deflector 180 is mounted on the receptacle 174 generally above the port 154 in a position in which a fluid stream from the port 154 can pivot the deflector 180 about a pivot 182 to a position in which the deflector 180 blocks off the opening 178 to a sufficient extent so that a ball 170 cannot move through this opening 178. The deflector 180 normally hangs downwardly as a result of the action of gravity from the pivot 182 so as to block off another opening 184 leading from te bottom 186 of the receptacle 174. With this structure every time the deflector 180 is pivoted upwardly to any significant extent the opening 184 will be exposed so that any ball 170 in the receptacle 174 will move downwardly out of the receptacle 174.

This mode of operation can contribute quite significantly to the amusement value of a device such as the device 100. In order to obtain an effective action which will not tend to discourage an individual from utilizing the device 100 it is preferred to mount the deflector 180 in a position as shown just slightly out of alignment with the port 154 so that by controlling the rate at which the bellows 130 is compressed a degree of control of the movement of the deflector 180 can be achieved.

Figure 8:
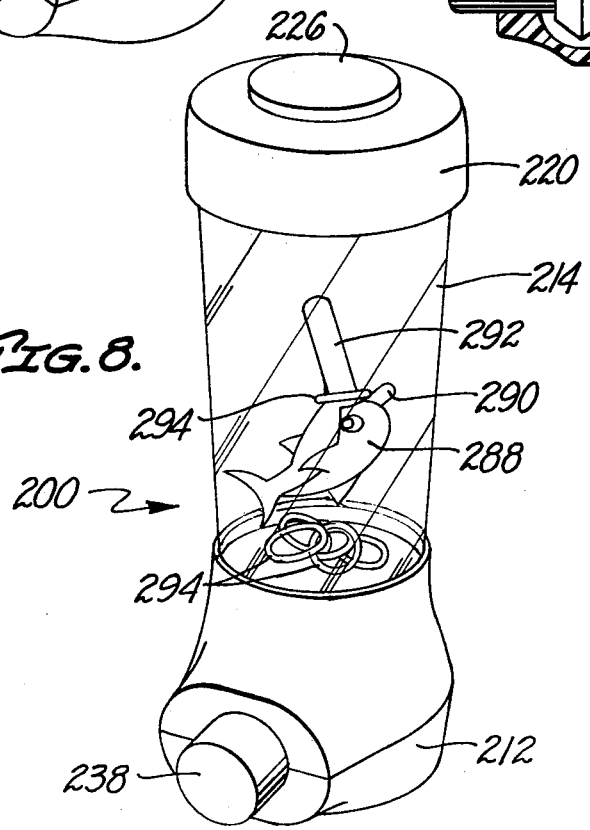
FIG. 8 is an isometric view of a further modified amusement device in accordance with this invention.

In the FIG. 8 of the drawing there is shown another modified amusement device 200 in accordance with this invention. This device 200 utilizes many parts which are identical to parts employed in the device 10. Those parts of the device 200 which reasonably correspond to parts of the device 10 are not separately described herein and are indicated in the remainder of this specification and in the drawing by the numerals previously used to designate such parts preceded by the numeral "2".

The device 200 does not utilize a receptacle such as the receptacle 64 but instead employs a target 288 such as a simulated fish which is pivotally mounted by means of a pivot 290 generally above the port 254 in such a manner that this target 288 will oscillate back and forth as the bellows 230 in it is operated. This target 288 includes an upwardly extending projection 292 and is utilized with small rings 294 which are adapted to fit over this projection 292 as the device 200 is used. These rings 294 roughly correspond to the balls 70 previously described.

The balls 70, 170 and the rings 194 are all objects which are adapted to be moved as a result of fluid flow in the devices 10, 100 and 200 described in the preceding. Normally any of such objects will be constructed of a material having a specific gravity which is greater than the specific gravity of the fluid in which they are used. However, it is considered that the degree of difficulty in utilizing any of the devices described can be increased by forming any of such objects of a material having a specific gravity which is approximately the same as the specific gravity of the fluid used. When such objects are formed so as to have such a specific gravity they will tend to float within the fluid employed and this will, of course, tend to make it more difficult for them to be located or captured within the receptacles 64 and 174 serving as targets or upon the target 288. Any such object should have a specific gravity no greater than the fluid with which it is used so as to avoid any such object floating upon the surface of such fluid.

I claim:

1. An amusement device including a container at least a part of which is transparent, a body of transparent fluid located within said container, at least one object located within said body of fluid, said object being visible from the exterior of said container, and pump means for circulating said fluid within said container so that movement of said fluid within said container will cause movement of said object within said body of fluid in which the improvement comprises:

a target means for retaining said object as said device is used, said target means being located within the interior of said container so as to be visible from the exterior thereof, at least part of said target means being movably mounted within said container so as to be capable of moving with respect to the interior of said container during the operation of said device, said pump means having a port located so as to be capable of directing a current of fluid generally toward said part of said target means so that the pressure of said current against said part will cause movement of said part as said pump means is operated so as to eject fluid through said port, said part being located so that the position of said part resulting from the operation of said pump means affects the relative difficulty of moving said object so that it is retained by said target means.

2. An amusement device as claimed in claim 1 wherein:

said target means comprises a recptacle and a lid for said receptacle, said lid being movably mounted with respect to said receptacle so as to be capable of being moved in order to open and close said receptacle, said lid being said part of said target means, said lid extending from said receptacle a sufficient distance so as to be capable of being engaged by circulating fluid within said container in order to open said receptacle.

3. An amusement device as claimed in claim 2 including:

said target means are located within said container so that said lid will be engaged by said current of fluid in order to be moved so as to open said receptacle.

4. An amusement device as claimed in claim 3 including:

baffle means for directing said stream of fluid toward said lid.

5. An amusement device as claimed in claim 1 wherein:

said target means includes a receptacle having an immobile baffle-like lid extending therefrom, said lid being spaced with respect to the remainder of said receptacle in order to provide an opening into the interior of said receptacle, said target means also including a deflector movably mounted relative to said receptacle and said lid so as to be capable of being moved by fluid circulating within said container so as to close off said opening, said deflector constituting said part of said target means.

6. An amusement device as claimed in claim 5 wherein:

said receptacle has an opening leading from the interior thereof into said container, said other opening being located so as to be normally covered by said deflector except when said deflector is moved by fluid circulating within said container.

7. An amusement device as claimed in claim 1 wherein:

said target means comprises a member movably mounted within the interior of said container, said member including means for retaining at least one object when said object is circulated within said container, said member being capable of being moved by engagement with said fluid circulating within said container so as to vary the position of said means for retaining said object.

8. An amusement device as claimed in claim 7 wherein:

said object comprises a ring and said means for retaining said object comprises a projection.

* * * * *